US009968213B2

(12) United States Patent
Hsu et al.

(10) Patent No.: US 9,968,213 B2
(45) Date of Patent: May 15, 2018

(54) ROMAN SHADE WITH TRANSLUCENT LAYER AND OPAQUE LAYER

(71) Applicants: Sheng Ying Hsu, Changhua County (TW); Chun Jan Hsu, Changhua County (TW)

(72) Inventors: Sheng Ying Hsu, Changhua County (TW); Chun Jan Hsu, Changhua County (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 0 days. days.

(21) Appl. No.: 15/607,373

(22) Filed: May 26, 2017

(65) Prior Publication Data

US 2017/0340157 A1 Nov. 30, 2017

(30) Foreign Application Priority Data

May 27, 2016 (TW) ..... 105207891 U

(51) Int. Cl.

| | |
|---|---|
| ***A47H 23/06*** | (2006.01) |
| ***A47H 23/01*** | (2006.01) |
| *E06B 9/262* | (2006.01) |
| *E06B 9/24* | (2006.01) |

(52) U.S. Cl.

CPC ..... *A47H 23/06* (2013.01); *A47H 23/01* (2013.01); *E06B 2009/2452* (2013.01); *E06B 2009/2625* (2013.01)

(58) Field of Classification Search

CPC ..... E06B 9/262; E06B 2009/2405; E06B 2009/2423; E06B 2009/2452; E06B 2009/2622; E06B 2009/2625; A47H 23/06; A47H 23/01

See application file for complete search history.

(56) References Cited

U.S. PATENT DOCUMENTS

| | | | | |
|---|---|---|---|---|
| 7,150,304 | B2 * | 12/2006 | Hsu | E06B 9/262 160/348 |
| 9,574,394 | B2 | 2/2017 | Hsu et al. | |
| 9,677,328 | B2 * | 6/2017 | Hsu | E06B 9/262 |
| 2012/0102707 | A1 * | 5/2012 | Chen | E06B 9/262 29/428 |
| 2012/0234502 | A1 * | 9/2012 | Chen | E06B 9/262 160/84.01 |
| 2016/0120352 | A1 * | 5/2016 | Hsu | E06B 9/262 160/201 |
| 2016/0376837 | A1 | 12/2016 | Hsu et al. | |
| 2016/0376838 | A1 * | 12/2016 | Hsu | E06B 9/28 160/84.03 |

(Continued)

*Primary Examiner* — Blair M Johnson

(74) *Attorney, Agent, or Firm* — Che-Yang Chen; Law Offices of Scott Warmuth

(57) ABSTRACT

A Roman shade includes a translucent layer and at least one opaque layer. The translucent layer is connected to the top box. Multiple rows of first magnets are positioned transversely on the translucent layer. A translucent area is formed between any two adjacent rows of the first magnets. The opaque layer includes multiple rows of second magnets positioned transversely thereon, and an opaque area is formed between two any adjacent rows of the second magnets. The at least one opaque layer is folded to attract the second magnets on the at least one opaque layer to the first magnets on the translucent layer to expose the translucent areas.

5 Claims, 13 Drawing Sheets

(56) References Cited

U.S. PATENT DOCUMENTS

| | | | | |
|---|---|---|---|---|
| 2017/0138121 | A1* | 5/2017 | Hsu | E06B 9/262 |
| 2017/0218693 | A1* | 8/2017 | Hsu | E06B 7/28 49/380 |

* cited by examiner

ROMAN SHADE WITH TRANSLUCENT LAYER AND OPAQUE LAYER

BACKGROUND OF THE INVENTION

1. Fields of the Invention

The present invention relates to a Roman shade with a translucent layer and an opaque layer which is adjustable relative to the translucent layer.

2. Descriptions of Related Art

The conventional window shades are controlled by operation of the control cords. The cords are exposed especially when the shade is lifted to upper position, and the exposed cords include potential danger factor to children. U.S. Pat. No. 7,150,304 discloses a cordless window shade that uses magnets to position the shade at a desired height. The cordless shade does not need worm gear set and cords to position the shade so as to improve the shortcomings mentioned above. The magnets are positioned at the surface of the shade at even distance, when lifting the shade, the bottom end of the shade is folded upward to attach the magnets on the bottom end to the magnets at higher positions. When expand the shade, separating the attached magnets, the shade is expanded.

Nevertheless, the shade are made of material that blocks light from outside of the room, even when the shade is lifted at a certain height, the light outside will be too bright to the people in the room. Furthermore, once the shade is lifted, there will be no privacy for the people in the room.

The present invention intends to provide a Roman shade that includes a translucent layer and an opaque layer, and the opaque layer is operated and positioned at desired height relative to the translucent layer so as to adjust the translucent area and the brightness in the room.

SUMMARY OF THE INVENTION

The present invention relates to an Roman shade and comprises a translucent layer having a top end and a bottom end, wherein the top end is connected to a top box. Multiple rows of first magnets are positioned transversely on the translucent layer. A translucent area is formed between any two adjacent rows of the first magnets. At least one opaque layer has a first end and a second end, wherein multiple rows of second magnets are positioned transversely on the at least one opaque layer. An opaque area is formed between any two adjacent rows of the second magnets. An area of the opaque area is the same as that of the translucent area. At least one pull collar is connected to the at least one opaque layer. The at least one opaque layer is folded to attract the second magnets of the at least one opaque layer to the first magnets of the translucent layer to expose the translucent areas.

The advantages of the present invention are that the Roman shade includes a translucent layer and at least one opaque layer which is magnetically detachable relative to the translucent layer so as to expose the translucent area when the at least one opaque layer is lifted one section by one section. The translucent area is exposed where the opaque layer is not covered on the translucent layer.

When the opaque layer is lifted from the translucent layer and the translucent area is exposed, the privacy of the activities in the room is maintained.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
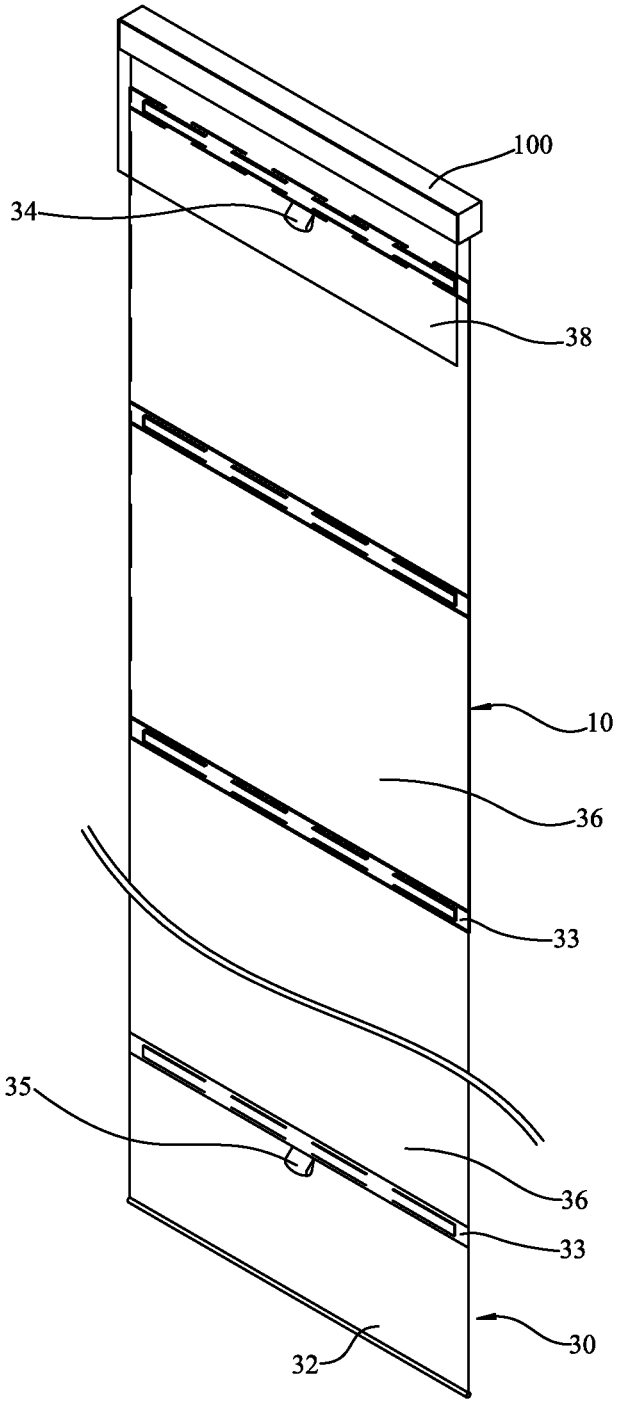
FIG. 1 is a perspective view to show the Roman shade of the present invention.

Referring to FIGS. 1 to 4, the Roman shade of the present invention comprises a translucent layer 10 and an opaque layer 30, wherein the translucent layer 10 includes a top end 11 and a bottom end 12, and the top end 11 is connected to a top box 100. Multiple rows of first magnets 20 are positioned transversely on the translucent layer 10. Multiple rows of first folding portions 13 are formed on the translucent layer 10, and each first folding portion 13 includes a passage in which the first magnets 20 are received. A translucent area 15 is formed between any two adjacent rows of the first folding portions 13 or first magnets 20. The first folding portions 13 are equally spaced apart from each other, and can be sewed to the translucent layer 10.

The opaque layer 30 includes a first end 31 and a second end 32. Multiple rows of second magnets 40 are positioned transversely on the opaque layer 30. Specifically, the opaque layer 30 includes multiple rows of second folding portions 33 and each second folding portion 33 includes a passage in which the second magnets 40 are received. The second folding portions 33 are equally spaced apart from each other, and can be sewed to the opaque layer 30. An opaque area 36 is formed between any two adjacent rows of the second magnets 40. Preferably, the area of the opaque area 36 is the same as that of the translucent area 15. A decorative fabric 38 can be connected to the top box 100 to hide a portion of the Roman shade. A pull collar 34 is connected to the second folding portion 33 at the first end 31 of the opaque layer 30. Another pull collar 35 is connected to the second folding portion 33 that is located close to the second end 32.

When in use, the user holds the pull collar 34 and let the second magnets 40 in the second folding portion 33 at the first end 31 be attracted by the first magnets 20 in the first folding portion 13 at the bottom end 12 so that the opaque layer 30 is attached to the translucent layer 10 as shown in FIG. 1. All of the translucent areas 15 are covered by the opaque areas 36. The Roman shade is in its expanded status.

Figure 5:
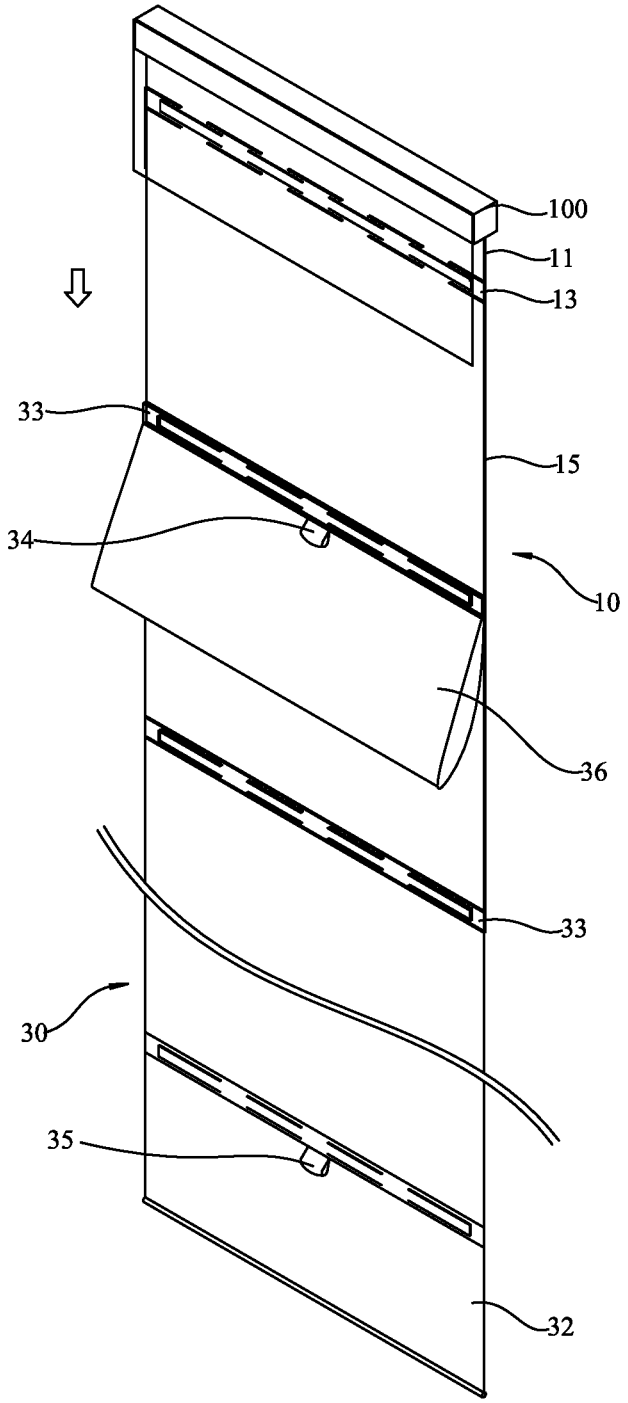
FIG. 5 shows that a portion of the opaque layer is folded upward relative to the translucent layer.
Figure 6:
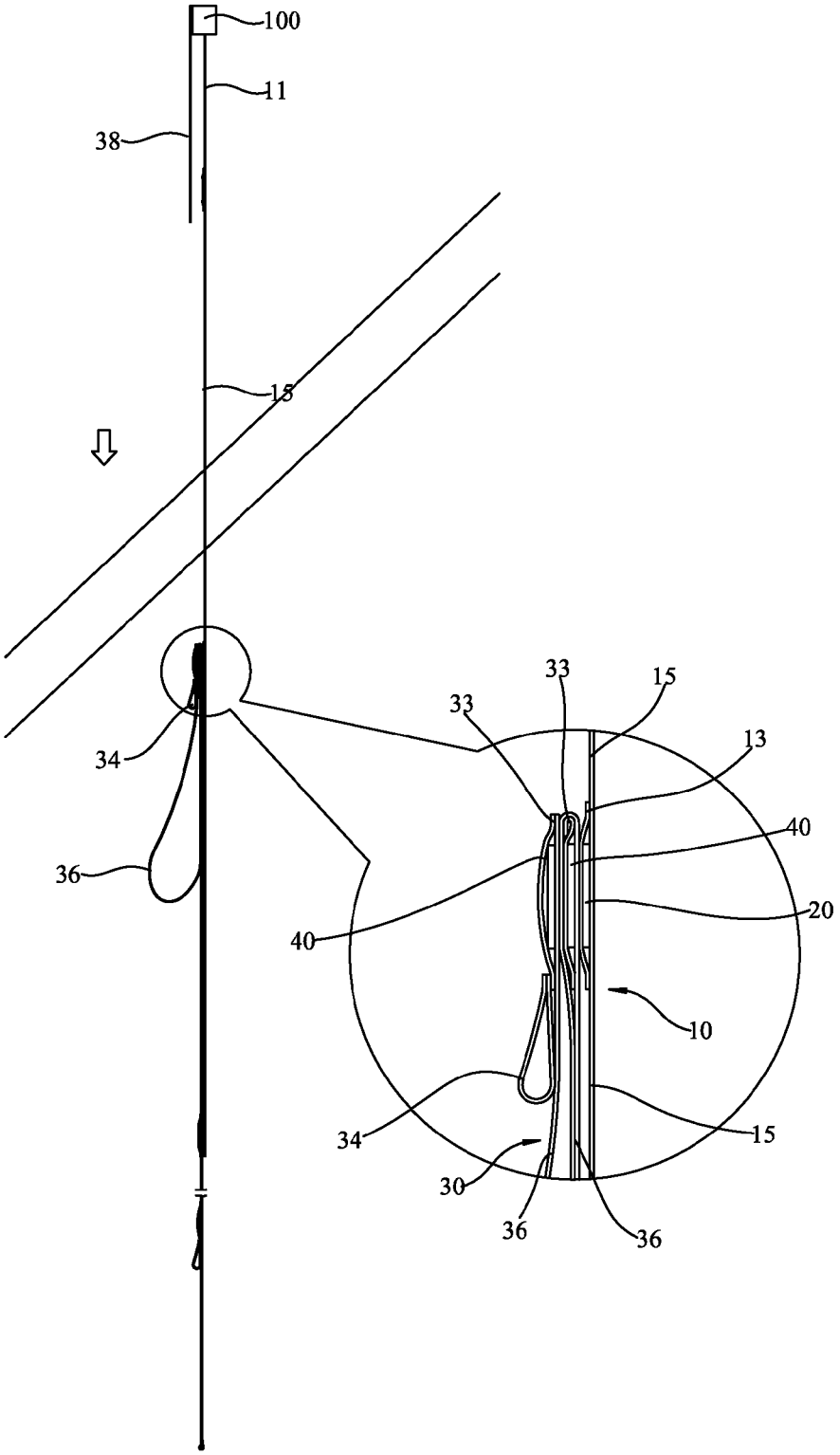
FIG. 6 shows the side view of the Roman shade disclosed in FIG. 5.

As shown in FIGS. 1, 5 and 6, when the user wants to have the top portion of the Roman shade to be translucent, he or she lifts the pull collar 34 at the first end 31 of the opaque layer 30 to separate the first and second magnets 20, 40, and folds the opaque area 36 downward to let the second magnets 40 at the first end 31 be attracted by the downward next rows of the second magnets 40. As shown in FIG. 6, there will be two rows of the second magnets 40 attracted to the first magnets 20, and the top translucent area 15 beneath the top box 100 is exposed and allows a portion of outside light to come into the room.

Figure 7:
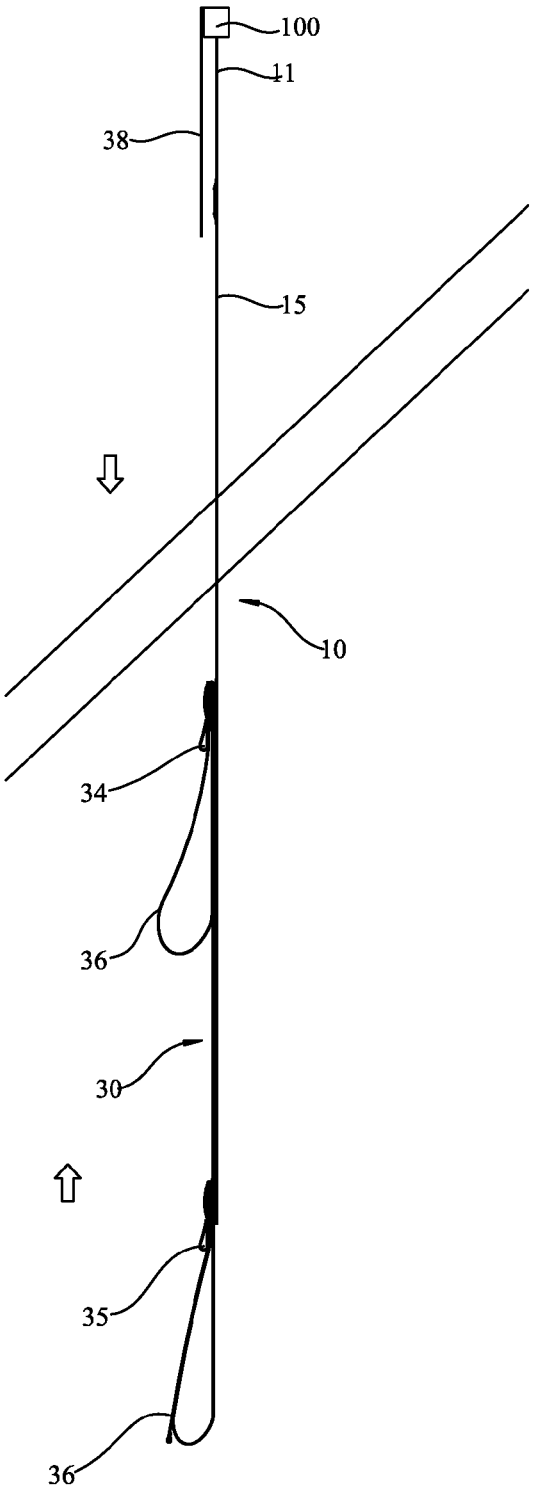
FIG. 7 is a side view to show another status of the Roman shade of the present invention.

As shown in FIGS. 5 and 7, the user can lifts the pull collar 35 at the second end 32 of the opaque layer 30 and fold the opaque area 36 upward to let the second magnets 40 of that lifted second folding portion 33 to be attracted by the upward next row of the second magnets 40. Therefore, there will be two folded opaque areas 36 to form a wave-shape appearance.

Figure 2:
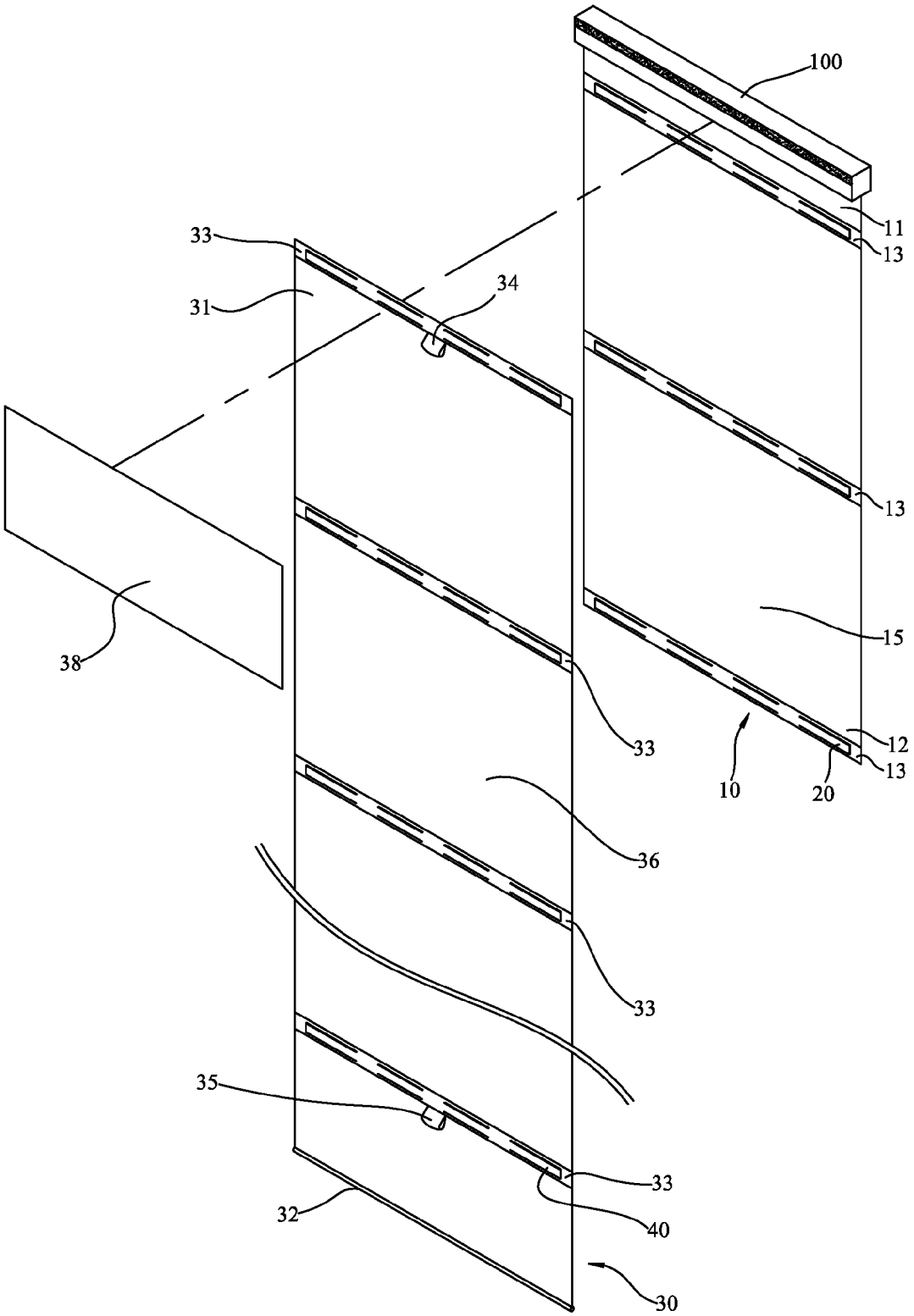
FIG. 2 is an exploded view of the Roman shade of the present invention.
Figure 3:
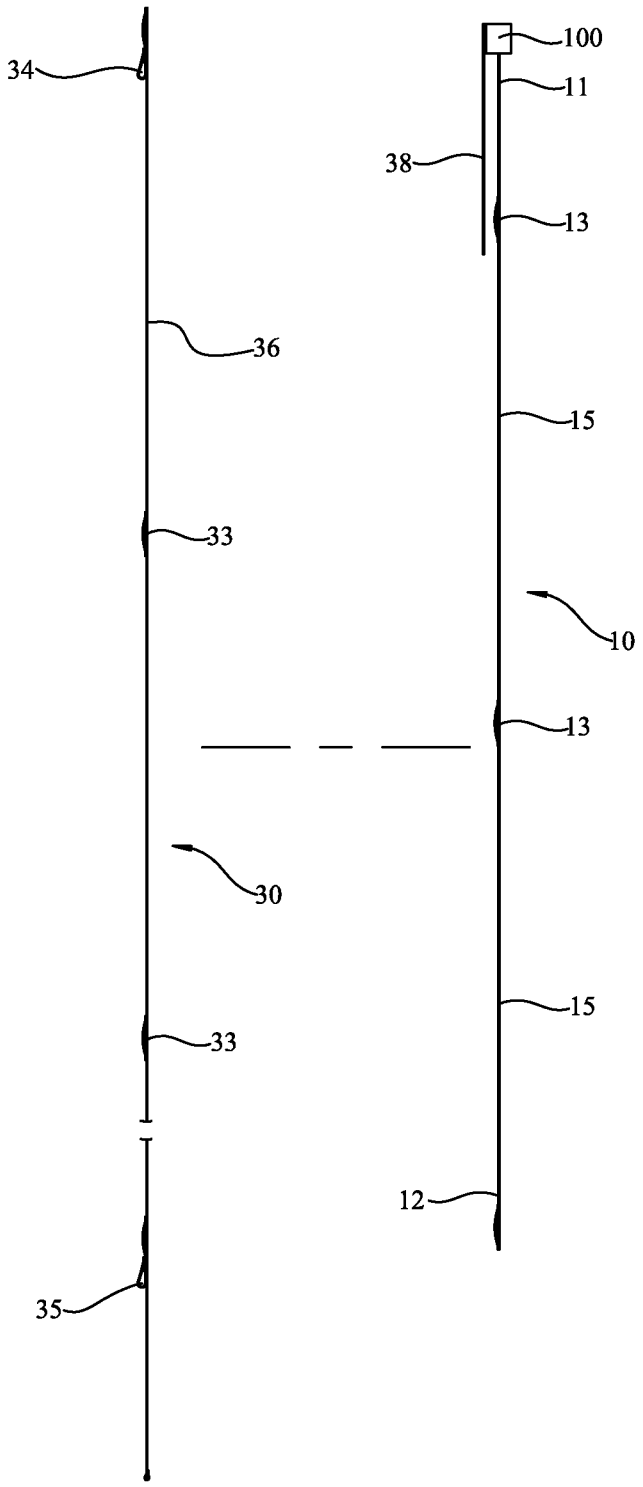
FIG. 3 is a side view of the translucent layer and the opaque layer of the Roman shade of the present invention.
Figure 4:
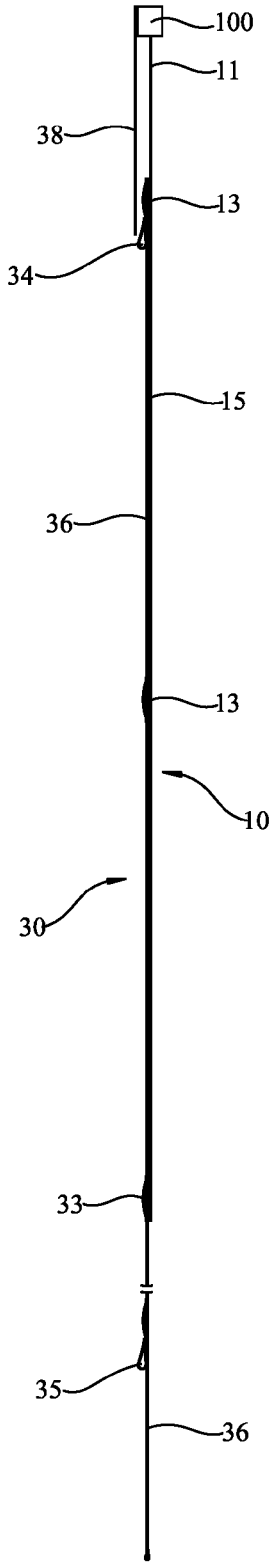
FIG. 4 is a side view of the Roman shade of the present invention.
Figure 8:
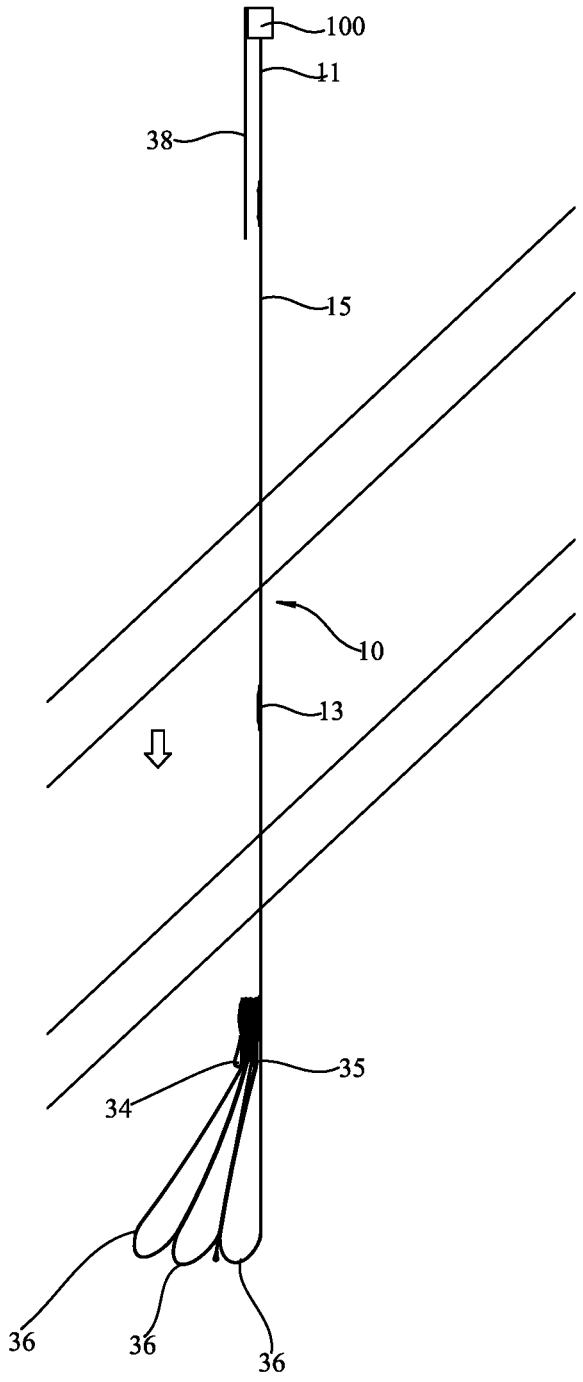
FIG. 8 is a side view to show yet another status of the Roman shade of the present invention.

As shown in FIGS. 2, 7 and 8, when the user want to increase the area of the translucent area 15, the pull collar 34 is pulled again to separate the first and second magnets 20, 40, and moves the opaque area 36 downward from the status disclosed in FIG. 7 to move the second folding portion 33 that the pull collar 34 is connected and the next second folding portion 33 downward, so as to be attracted to the second magnets 40 of the second folding portion 33 at the second end 32. In other words, there are three rows of the second magnets 40 are attracted by the first magnets 20 at the bottom end 12 of the translucent layer 10. Under this status, all of the translucent areas 15 are not covered.

Figure 9:
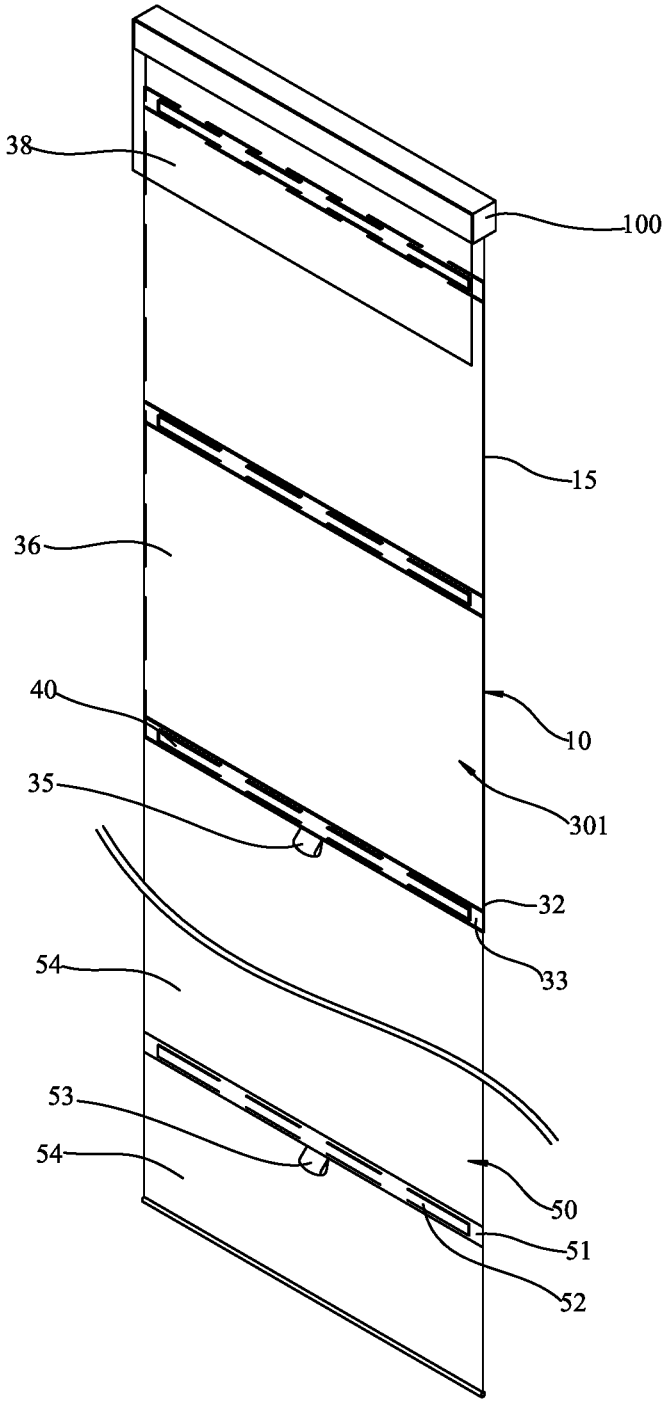
FIG. 9 is a perspective view to show another embodiment of the Roman shade of the present invention.
Figure 10:
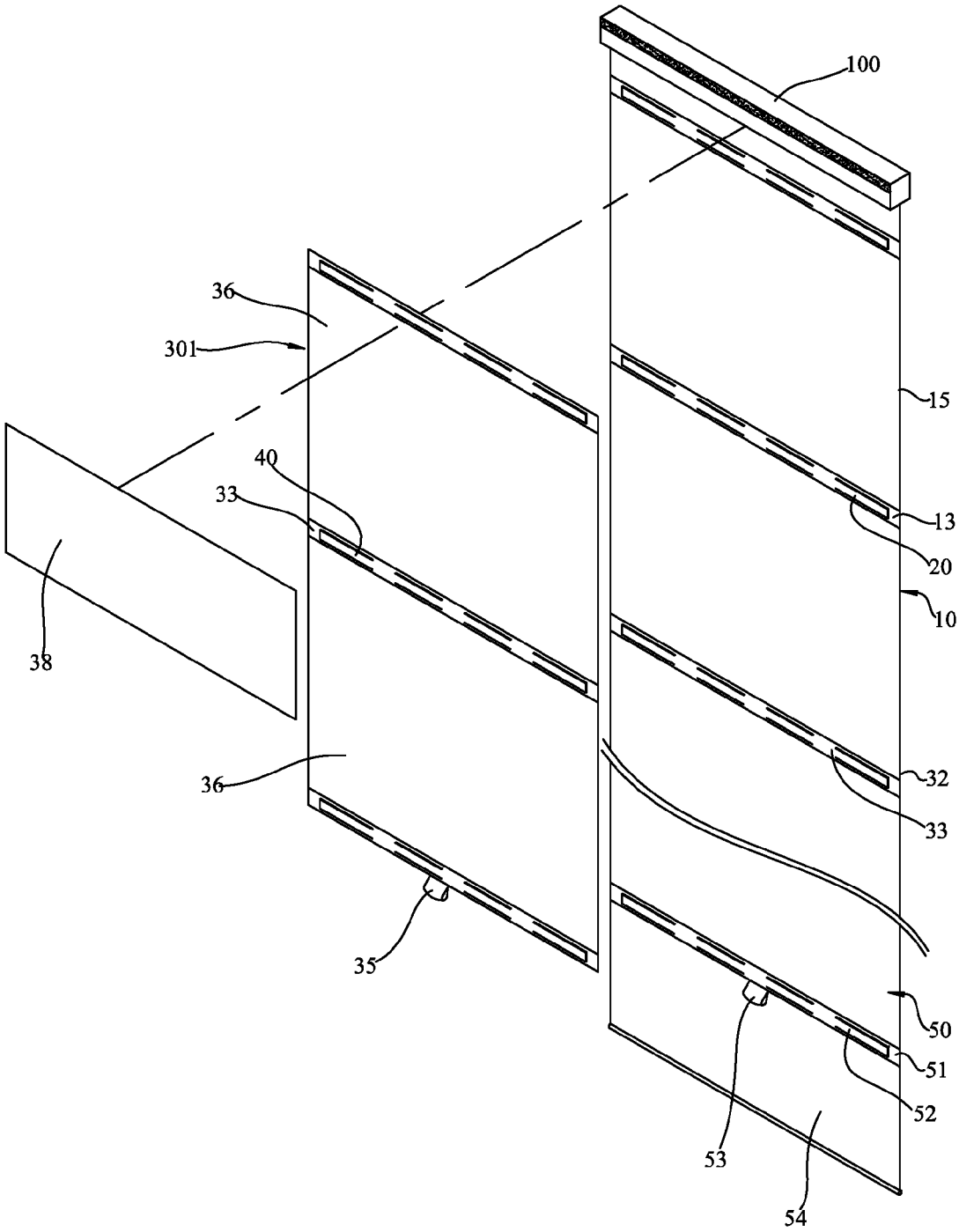
FIG. 10 is an exploded view of the Roman shade disclosed in FIG. 9.
Figure 11:
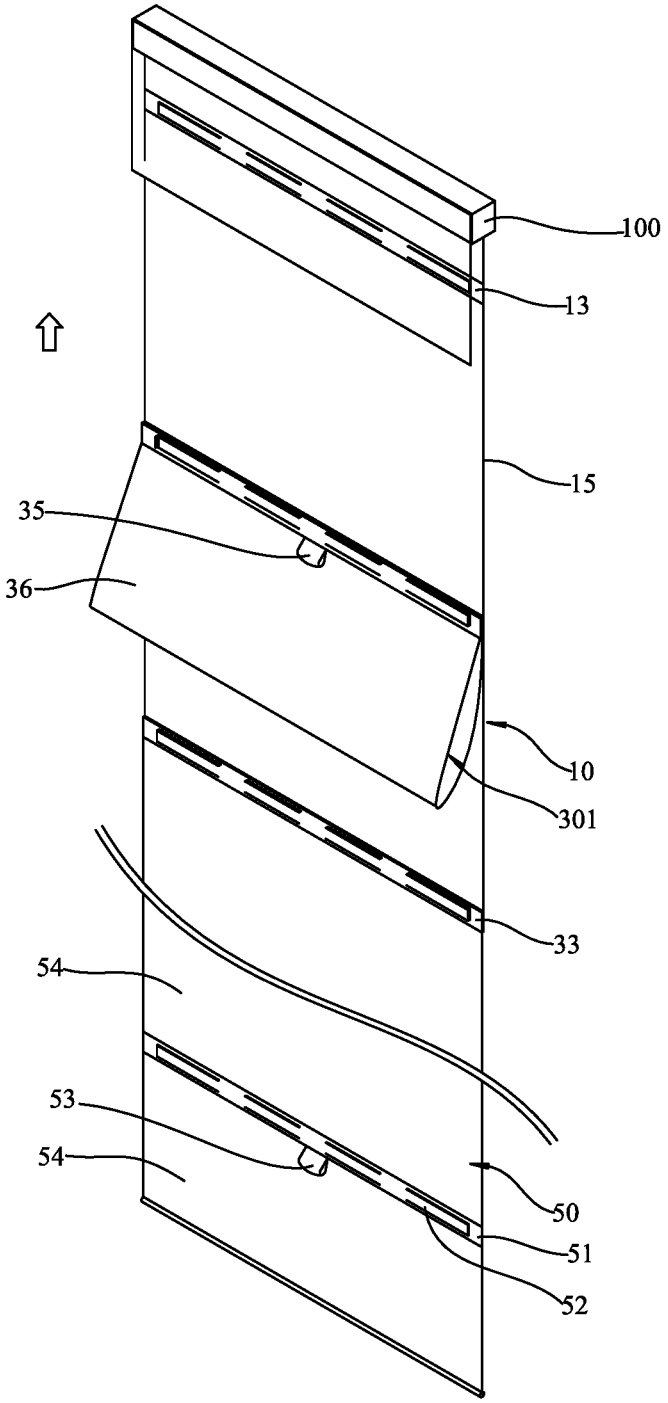
FIG. 11 shows one status of the Roman shade disclosed in FIG. 9.

As shown in FIGS. 9 to 11, this embodiment shows that the opaque layer can be separated at the middle thereof to form a two-piece opaque layer which includes two opaque layers 301, 50. The opaque layer 50 has its top end connected to the bottom end 12 of the translucent layer 10, and includes multiple third folding portions 51 in each of which third magnets 52 are received. A pull collar 53 is connected to the lowest third folding portion 51. An opaque area 54 is formed between any two adjacent third folding portions 51.

The opaque layer 301 is attached to the translucent layer 10 and the pull collar 35 is located at the second folding portion 33 at the second end 321 of the opaque layer 301. When pull collar 35 of the opaque layer 301 is located corresponding to the second folding portion 33 at the lower end of the opaque layer 301 as shown in FIG. 10. The opaque layer 301 is attached to the translucent layer 10, and the opaque area 36 covers the translucent area 15. The other opaque layer 50 is connected to the bottom end 12 of the translucent layer 10 so that when the two opaque layers 301, 50 are fully expanded, the translucent layer 10 is completely covered.

Figure 12:
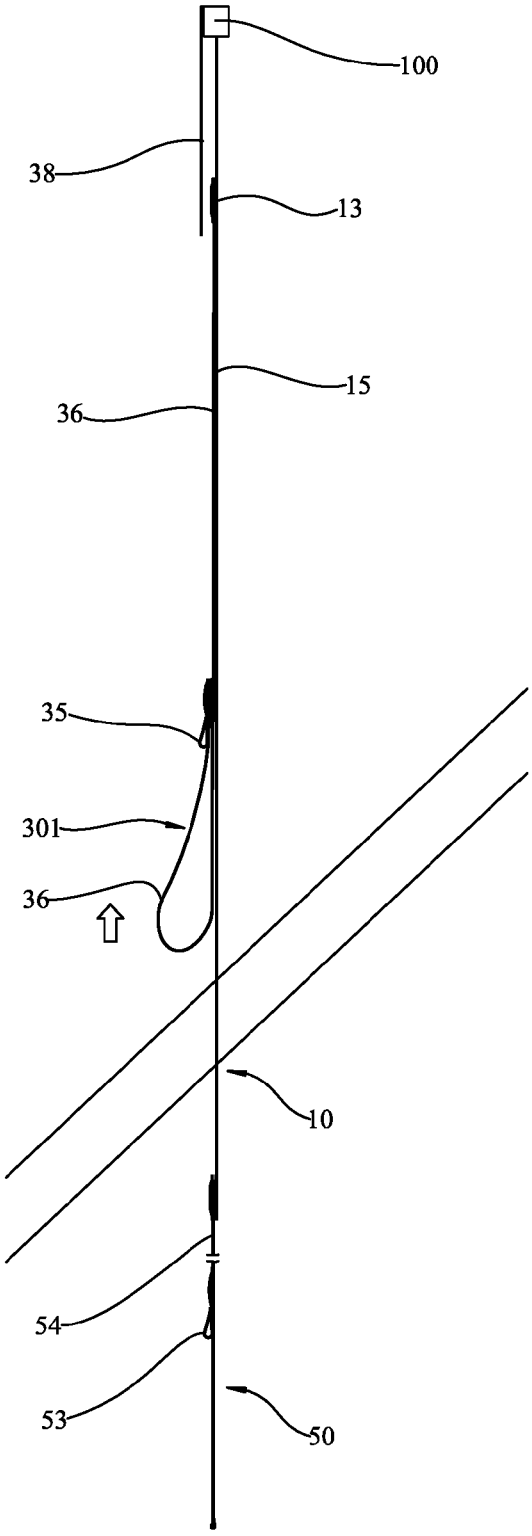
FIG. 12 is a side view of the Roman shade disclosed in FIG. 11.
Figure 13:
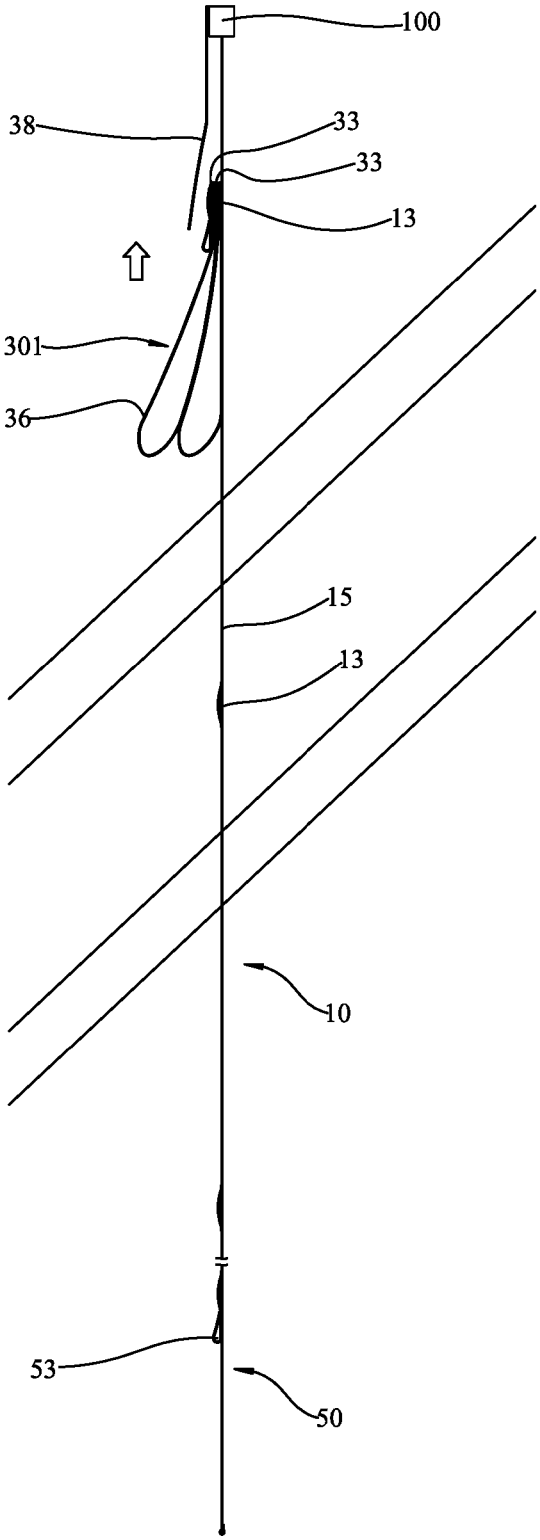
FIG. 13 shows another status of the Roman shade disclosed in FIG. 11.

As shown in FIGS. 11 to 13, the opaque layer 301 can be folded upward by pulling the pull collar 35 to fold the opaque area 36 section by section to let the second magnets 40 in the second folding portions 33 be attracted to the first magnets 20 at the top end 11 of the translucent layer 10. Therefore, the translucent areas 15 of the translucent layer 10 are exposed.

While we have shown and described the embodiment in accordance with the present invention, it should be clear to those skilled in the art that further embodiments may be made without departing from the scope of the present invention.

What is claimed is:

1. A Roman shade comprising:

a translucent layer having a top end and a bottom end, the top end adapted to be connected to a top box, multiple rows of first magnets positioned on the translucent layer, each row of first magnets being positioned transversely, a translucent area formed between any two adjacent rows of the first magnets, and at least one opaque layer having a first end and a second end, multiple rows of second magnets positioned transversely on the at least one opaque layer, an opaque area formed between any two adjacent rows of the second magnets, an area of the opaque area being the same as that of the translucent area, at least one pull collar connected to the at least one opaque layer, the at least one opaque layer adapted to be folded to attract the second magnets of the at least one opaque layer to the first magnets of the translucent layer to expose the translucent areas.

2. The Roman shade as claimed in claim 1, wherein the translucent layer includes multiple rows of first folding portions and each first folding portion includes a passage in which the first magnets are received, the translucent area is formed between any two adjacent rows of the first folding portions.

3. The Roman shade as claimed in claim 1, wherein a length between the first and second ends of the at least one opaque layer is longer than a length between the top end and the bottom end of the translucent layer, a width of the at least one opaque layer is the same as that of the translucent layer, the at least one opaque layer includes multiple rows of second folding portions and each second folding portion includes a passage in which the second magnets are received.

4. The Roman shade as claimed in claim 3, wherein the at least one pull collar is connected to the first end of the at least one opaque layer, another pull collar is connected to the second folding portion that is located close to the second end.

5. The Roman shade as claimed in claim 1, wherein the at least one opaque layer includes a first piece and a second piece, the first piece is magnetically detachably connected to the translucent layer, the second piece has a top end thereof fixed to the bottom end of the translucent layer, the second piece includes multiple rows of third magnets connected thereto, each row of third magnets is positioned transversely, the at least one pull collar is fixed to a bottom end of the third piece.

* * * * *